US005966572A

United States Patent [19]

Mishra et al.

[11] Patent Number: 5,966,572

[45] Date of Patent: Oct. 12, 1999

[54] PHOTOCONDUCTOR BELT SEAM DETECTION

[75] Inventors: Satchidanand Mishra; Edward F. Grabowski; Bing R. Hsieh; Robert C. U. Yu, all of Webster; Anthony M. Horgan, Pittsford; Richard L. Post, Penfield; Donald C. VonHoene, Fairport, all of N.Y.

[73] Assignee: Xerox Corporation, Stamford, Conn.

[21] Appl. No.: 09/162,196

[22] Filed: Sep. 28, 1998

[51] Int. Cl.[6] ..... G03G 15/00

[52] U.S. Cl. ..... 399/160; 399/162; 198/810.01

[58] Field of Search ..... 399/160, 162; 198/810.01

[56] References Cited

U.S. PATENT DOCUMENTS 4,194,659 3/1980 Birch ..... 226/35

5,291,245 3/1994 Charnitski et al. ..... 355/208

5,455,136 10/1995 Yu et al. ..... 430/59

*Primary Examiner*—Arthur T. Grimley

*Assistant Examiner*—Greg Moldafsky

*Attorney, Agent, or Firm*—H. Fleischer; J. E. Beck

[57] ABSTRACT

An electrophotographic printing machine that has a photoconductive belt with a skewed seam thereon. The position of the skewed seam is detected by a pair of seam detection devices. The seam detection devices are spaced from one another and adapted to transmit a pair of signals with the signals having a time interval therebetween. These signals are inputted to a detection circuit and, if the time interval between signals is within a preselected tolerance, the detection circuit generates a seam indication signal. In this way, scratches on the photoconductive surface may be discriminated from the seam.

14 Claims, 3 Drawing Sheets

PHOTOCONDUCTOR BELT SEAM DETECTION

This invention relates generally to an electrophotographic printing machine, using a seamed photoconductive belt adapted to have recorded thereon a plurality of electrostatic latent images. More particularly, this invention is directed to detecting the seam of the photoconductive belt.

A typical electrophotographic printing machine employing a photoconductive belt charges the belt to a substantially uniform potential so as to sensitize the surface thereof. The charged portion of the photoconductive belt is exposed to a light image of an original document being reproduced. Exposure of the charged photoconductive belt selectively dissipates the charge thereon in the irradiated areas to record an electrostatic latent image on the photoconductive belt corresponding to the informational areas contained in the original document. After the electrostatic latent image is recorded on the photoconductive belt, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image forming a visible powder image on the photoconductive surface. After the electrostatic latent image is developed with the toner particles, the toner powder image is transferred to a sheet. Thereafter, the toner image is heated to permanently fuse it to the sheet. When multiple copy jobs are being run with a photoconductive belt having a seam, it is necessary to track the position and timing of the seam to avoid having the seam falling into the document area. The seam presents a discontinuity in the photoreceptor surface. There are many ways of tracking the location of the seam. For example, a typical solution is to cut a hole in the belt at a predetermined displacement from the belt seam and detect the passage of the hole with a photosensor whose output is then used to control the various printing machine stations or the speed of the photoconductive belt so that the latent image is not recorded across the belt seam. Alternatively, notches are formed in the belt edge at known distances from the belt seam. These notches are detected by sensors which generate outputs used for timing and control purposes. Still another technique is to form toner registration marks along the edge of the belt, and/or in the frame area. These registration marks are detected by light from an array of light emitting diodes passing through the belt and falling on dedicated sensor arrays. The detected marks result in sensor signal outputs which are used to compensate for the detected registration deviation of the images formed on the belt. These techniques all require an additional process step in the manufacture of the photoconductor belt. With the ever-increasing emphasis on reduction of costs, it is highly desirable to eliminate timing holes, notches, or toner registration marks.

Photoconductor belts are usually fabricated from a sheet cut from a web. The sheets are generally rectangular in shape. All sides may be of the same length, or one pair of parallel sides may be longer than the other pair of parallel sides. The sheets are fabricated into a belt by overlap joining the opposite marginal end regions of the sheet. A seam is typically produced in the overlapping marginal end regions at the point of joining. Joining may be effected by any suitable means. Typical joining techniques include ultrasonic welding, gluing, taping, pressure heat fusing, and the like. Preferably, ultrasonic welding is used. The ultrasonic welded seams of multi-layered photoconductive belts are relatively brittle and of low elasticity and toughness. The photoconductive belt under goes stress and strain as it is cycled over a plurality of belt support rollers in a printing machine. The excessive thickness of the photoconductive belt in the seam region due to the presence of the splashings and seam overlap results in a large induced bending strain as the seam passes over each support roller. Generally, small diameter support rollers, highly desirable for simple, reliable copy paper self-stripping systems, are used in compact electrophotographic printing machines. This requires the photoconductive belt to operate in a very confined space. Small diameter rollers are generally used and these raise the threshold of the mechanical performance criteria for the photoconductive belts to a high level which may result in premature seam failure. Under dynamic fatiguing conditions, the seam overlap and splashing provide a focal point for stress concentration and become the initial point of failure that affects the mechanical integrity of the belt. It has been found that skewed seams extend the life of the photoconductive belt. A skewed seam is a seam in which the angle between the seam and the edge of the belt is less than 90°. Alternatively, the angle or skew may be measured as the number of degrees that the seam departs from a line perpendicular to the edge of the photoconductive belt. The slant or skew seam significantly reduces the destructive interaction of the seam with the cleaning blade of the printing machine. Thus, the photoconductive belt has a slant or skewed seam. It is necessary to detect this seam in order to ensure that the electrostatic latent images recorded on the belt do not fall on the seam. This may be done by using a sensor positioned on one side of the belt in opposed relationship to a light source. Illumination from the light source is detected by the sensor when the seam passes therebetween creating an output signal which is recognized by the system as an indication of the seam. The printing machine processing stations are then controlled to ensure that no latent image is recorded in the region of the seam. One problem that has arisen in using a system of this type for detecting the location of the seam is that scratches on the photoconductive belt give rise to a signal similar to that of a seam. The scratch signal frequently confuses the software of the printing machine. The nature of these scratches cannot be predetermined and can vary from situation to situation. Thus, they may not be readily eliminated through compensation in the software.

The following disclosures appear to be relevant to slant or skewed seams and detection of the seam:

U.S. Pat. No. 5,291,245

Patentee: Charnitski, et al

Issued: Mar. 1, 1994

U.S. Pat. No. 5,455,136

Patentee: Yu, et al

Issued: Oct. 3, 1995

U.S. Pat. No. 5,291,245 discloses an electrophotographic printing machine having a seamed photoconductive belt. The seam of the photoconductive belt is substantially perpendicular to the edge of the belt. A light source is positioned on one side of the photoconductive belt and a light detector on the other side thereof. The sensor detects the light transmitted through the seam as well as through the other portions of the photoconductive belt and transmits a signal corresponding thereto to a detection circuit. The detection circuit produces an output signal indicative of the seam location.

U.S. Pat. No. 5,455,136 describes a photoconductive belt having a skewed seam.

In accordance with one aspect of the features of the present invention, there is provided an apparatus for sensing a seam of a photoconductive belt mounted for movement. The seam extends in the direction substantially transverse to an edge of the photoconductive belt. A first seam detection device is positioned to detect a first portion of the seam and generates a first signal indicative thereof. A second seam detection device, spaced from the first seam detection device, detects a second portion of the seam and generates a second signal indicative thereof. There is a time delay between the first signal and the second signal. A detection circuit in communication with the first seam detection device and the second seam detection device generates a seam identification signal in response to the first signal and second signal, and the time interval therebetween.

Pursuant to another aspect of the present invention, there is provided an electrophotographic printing machine of the type in which a seam of a photoconductive belt is sensed. The photoconductive belt is mounted for movement with the seam extending in the direction substantially transverse to an edge of the photoconductive belt. A first seam detection device is positioned to detect a first portion of the seam and generates a first signal indicative thereof. A second seam detection device, spaced from the first seam detection device, detects a second portion of the seam and generates a second signal indicative thereof. There is a time interval between the first signal and the second signal. A detection circuit in communication with the first seam detection device and the second seam detection device generates a seam identification signal in response to the first signal and second signal, and the time interval therebetween.

Other aspects of the present invention will become apparent as the following description proceeds and upon reference to the drawings, in which.

Figure 1:
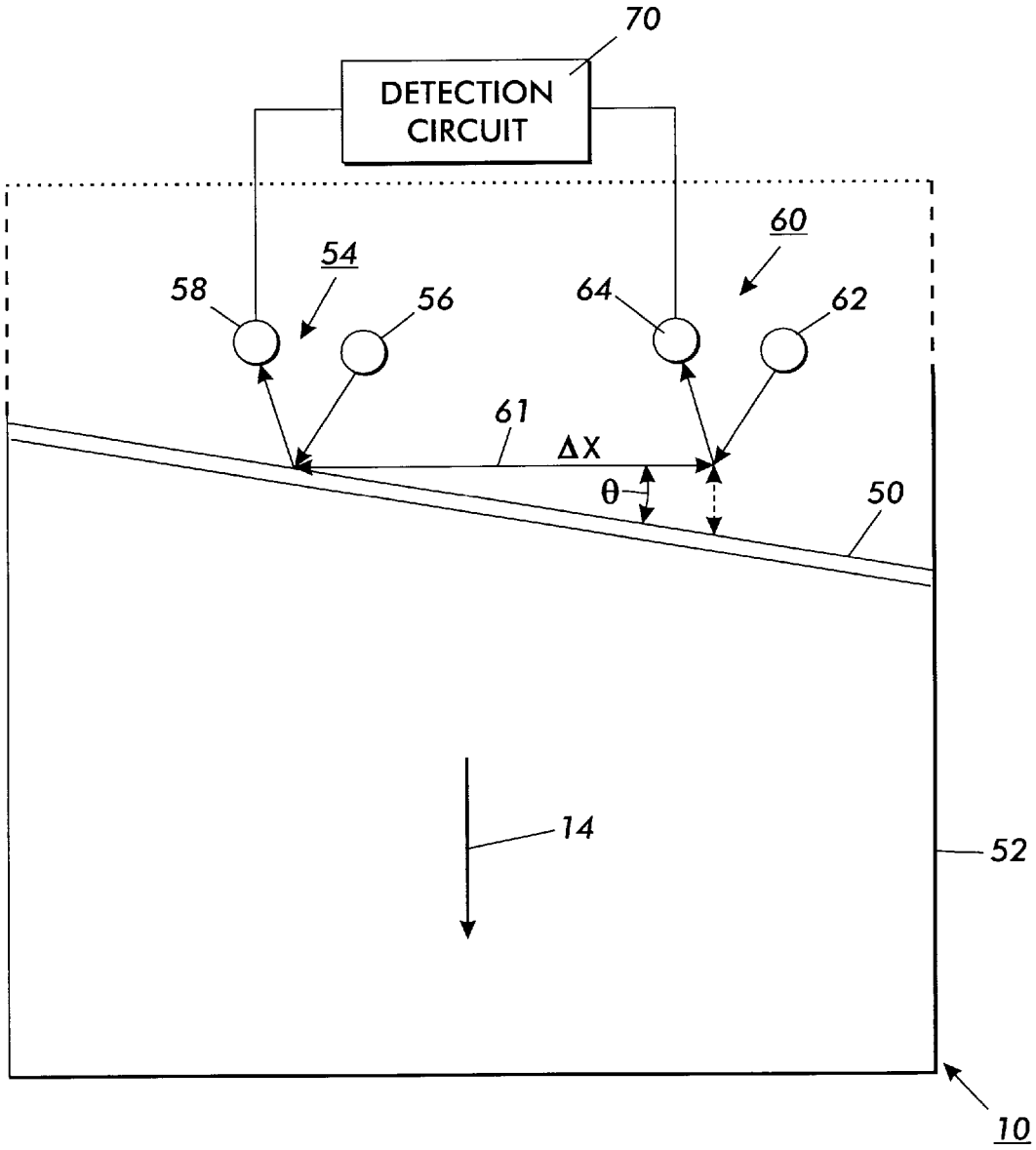
FIG. 1 is a schematic, plan view showing a first seam detection device and a second seam detection device detecting the seam on the photoconductive belt.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Figure 3:
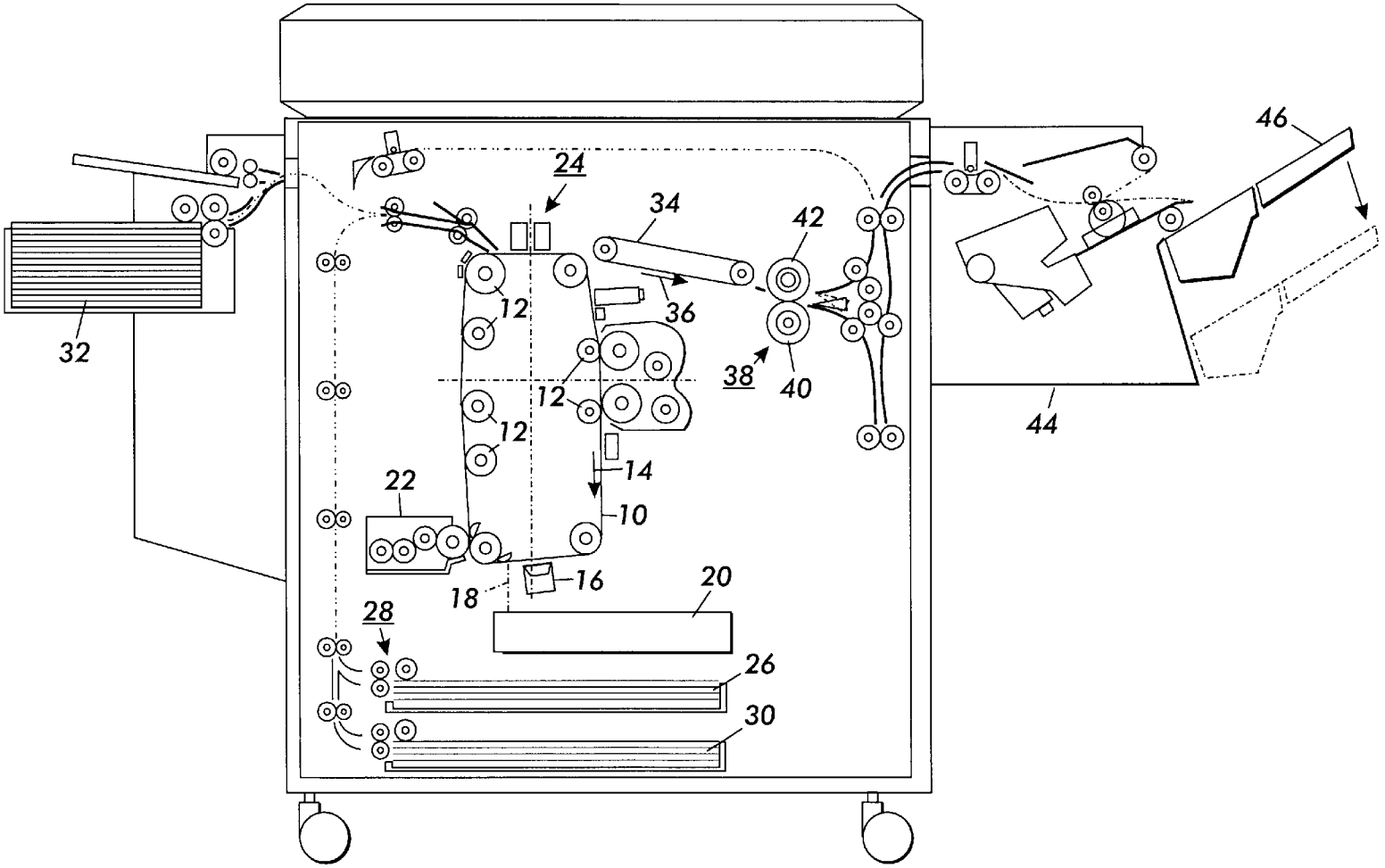
FIG. 3 is a schematic elevational view showing a printing machine incorporating the FIG. 1 photoconductive belt.

Referring initially to FIG. 3, there is shown an electrophotographic printing machine incorporating a photoconductive belt having a slant or skewed seam. The printing machine employs a photoconductive belt 10. Photoconductive belt 10 is of the type described in U.S. Pat. No. 5,455,136 issued Oct. 3, 1995 to Yu, et al., the relevant portions thereof being hereby incorporated into the present application. Belt 10 advances successive portion of the photoconductive surface sequentially through the various processing stations disposed about the path of movement thereof. A plurality of rollers or bars 12 provide support for belt 10. These rollers are spaced apart. Belt 10 advances in the direction of arrow 14. One of these rollers is rotatably driven by a suitable motor and drive (not shown) so as to rotate and advance belt 10 in the direction of arrow 14.

Initially, belt 10 passes through a charging station. At the charging station, a corona generating device 16 charges the photoconductive surface of belt 10 to a relatively high, substantially uniform potential.

After the photoconductive surface of belt 10 is charged, the charged portion thereof is advanced to an exposure station. At the exposure station, an imaging beam 18, generated by a rastor output scanner (ROS) 20 illuminates the charged portion of the photoconductive surface. ROS 20 employs a laser with rotating polygon mirrors to create the electrostatic latent image on the photoconductive surface of belt 10. This electrostatic latent image is positioned on the photoconductive surface of belt 10 so as to not fall on the seam thereon. This electrostatic latent image is developed by developer unit 22.

Developer unit 22 is a magnetic brush developer unit which deposits black toner particles on the electrostatic latent image. In this way, black toner develops the latent image. After the electrostatic latent image has been developed on the photoconductive surface of belt 10 with black toner particles, belt 10 continues to advance in the direction of arrow 14 to transfer station 24.

At transfer station 24, a sheet of support material is advanced from stack 26 by sheet feeders 28. Alternatively, the support material may be advanced from stack 30 or stack 32. In either case, the sheet of support material is advanced to transfer station 24 in registration with the toner image on belt 10. A corona generating device sprays ions onto the back side of the sheet of support material at transfer station 24. This attracts the developed image from the photoconductive surface of belt 10 to the sheet of support material. A vacuum transport 34 moves the sheet of support material in the direction of arrow 36 to fusing station 38. While transferring the developed image to a receiving medium has been described, wherein the receiving medium is a sheet of support material, e.g. paper, one skilled in the art will appreciate that the developed image may be transferred to an intermediate member, such as a belt or drum, and then subsequently transferred from the intermediate member to the sheet of paper and fused thereto.

Fusing station 38 includes a heated fuser roller 40 and a backup or pressure roller 42. The backup roller is resiliently urged into engagement with the fuser roller to form a nip through which the sheet passes. In the fusing operation, the toner particles coalesce and bond to the sheet in image configuration, forming a black image thereon. After fusing, the finished sheet is discharged to finishing station 44. At finishing station 44, sheets are compiled and stapled and/or adhesively bound to one another. After the finishing operation is completed, the finished set of sheets is advanced to catch tray 46 for subsequent removal therefrom by the machine operator.

Invariably, after the sheet is separated from the photoconductive surface of belt 10 at the transfer station, some residual particles remain adhering thereto. These residual particles are removed from the photoconductive surface at cleaning station 48. Cleaning station 48 includes a pair of rotatably mounted fibrous brushes or a rotating brush and a blade which are electrically biased to attract particles from the photoconductive surface. The brushes are in contact with the photoconductive surface. Subsequent to cleaning, a discharge lamp (not shown) floods the photoconductive surface with light to dissipate any residual or electrostatic charge remaining thereon prior to the charging thereof for the next successive imaging cycle.

Referring now to FIG. 1, there is shown photoconductive belt 10 having a skewed or slanted seam 50 thereon. Seam 50 extends in a transverse direction with respect to the edge 52 of belt 10. When seam 50 is perpendicular to edge 52 of photoconductive belt 10, the skew angle, θ, is 0°. As shown in FIG. 1, the skew angle θ ranges from about 2°to about 10°. A second seam detection device 54 includes a light emitting diode 56 and a light detector or photosensor 58. A first seam detection device 60 is spaced from the second seam detection device 54. First seam detection device 60 is substantially in line with the second seam detection device 54 along a line substantially perpendicular to edge 52 of belt 10. First seam detection device 60 includes a light emitting diode 62 and a light detector or photosensor 64. As shown in FIG. 1, the skew angle, θ, is measured with respect to the seam and a line perpendicular to edge 52 of belt 10. The portion of the photoconductive belt 10 that is illuminated by light emitting diode 56, and the other portion that is illuminated by light emitting diode 62 fall on a line 61 substantially perpendicular to edge 52 of belt 10. However, one skilled in the art will appreciate that the line 61 may be transverse to edge 52 of belt 10 and need not be perpendicular thereto. First seam detection device 60 and second seam detection device 54 are mounted fixedly at a fixed distance apart, ΔX, along line 61. Since seam 50 is slanted or skewed, the seam will cross the two spots of illumination at different times. The time interval between the two signals is equal to:

$$T=\Delta X \tan \theta / V$$

ΔX is the separation of the two light spots along a line perpendicular to edge 52 of belt 10, V is the velocity of belt 10 moving in the direction of arrow 14, and θ is the skew angle. The time interval, T, can range from about 50 ms to about 150 ms depending upon the characteristics of the photoconductive belt, the speed of operation thereof and the separation between the two detecting stations. The seam width ranges between 1 and 2 mm and generates a signal ranging from about 5 ms to about 10 ms in width. These numbers are based on a surface speed of 10"/sec. For higher speed such as 30"/sec the time interval T and the signal from the seam width both will be reduced by a factor of three. The fixed time interval between the two signals may be now used to discriminate against randomly present scratches and the seam location will not be confused.

Figure 2:
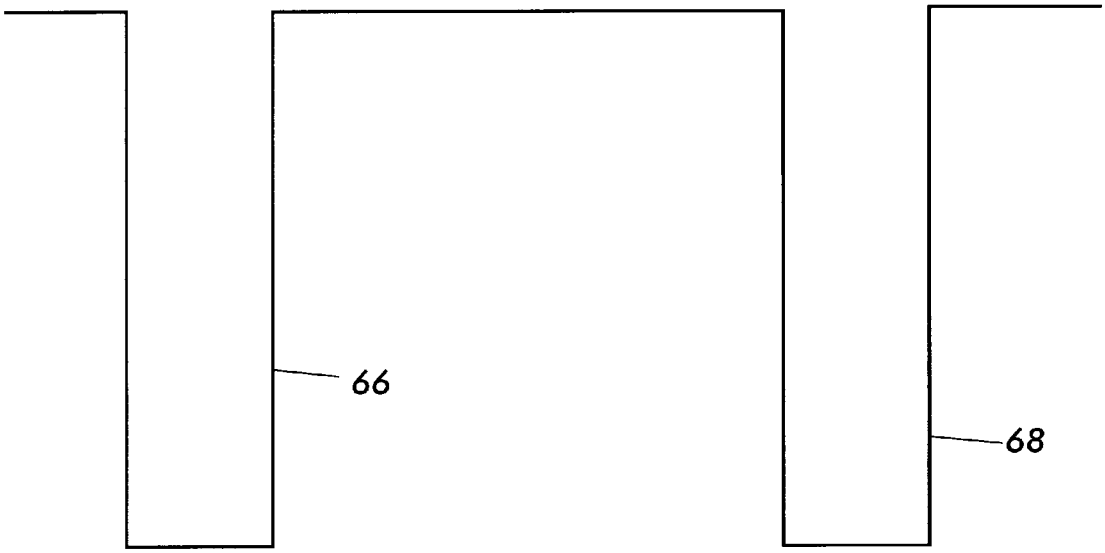
FIG. 2 is a graph showing the time interval between detecting the first portion of the seam and the second portion of the seam.

Turning now to FIG. 2, there is shown a graph depicting the first signal and the second signal. The first signal is indicated by the reference numeral 66 and the second signal by the reference numeral 68. With continued reference to FIG. 1, the first signal 66 and the second signal 68 from detectors 64 and 58, respectively, are transmitted to detection circuit 70. Detection circuit 70 measures the time interval between the first and second signals. If the time interval is within prescribed tolerances, detection circuit 70 generates a seam identification signal. This seam identification signal may be used to control the speed of the photoconductive belt or the various processing stations within the printing machine so as to ensure that no electrostatic latent image falls on the seam.

Referring once again to FIG. 2, signal 66 is generated by a first seam detection device 60 and signal 68 is generated by second seam detection device 54. The time interval between signal 66 and 68 may range from about 50 ms to about 150 ms depending upon the characteristics of the photoconductive belt and the speed thereof. In any event, the time interval is constant; for example, the time interval may be 100 ms. The width of the signals may range from about 5 ms to about 15 ms. Once again, for a selected photoconductive belt having a seam therein, this signal width will remain substantially constant and may, for example, be about 10 ms. The utilization of a pair of seam detection devices spaced from one another in conjunction with a skewed seam enables the detection circuit to discriminate between the seam and scratches on the photoconductive surface.

In another version of this there can be three or more devices consisting of a light emitting diode identical to 56 and a light detector or photosensor identical to 58. These can be mounted along a line perpendicular to the seam and a train of signal pulses can be generated. The relative time intervals between various stations can be used to detect the seam.

In another version of this the devices could be placed at an angle with the seam and need not be perpendicular to the edge of the photoreceptor.

In another version of this when three are more devices are being used they may not all be in a straight line and can be staggered for a better resolution of the separation of the signals arising from different stations.

In recapitulation, it is clear that the present invention is directed to an apparatus for sensing a seam of a photoconductive belt. The seam is skewed and a pair of seam detection devices are used to discriminate between the seam and scratches on the photoconductive surface.

It is therefore apparent that there has been provided in accordance with the present invention an apparatus for detecting a seam of a photoconductive belt. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. An apparatus for sensing a seam of a photoconductive belt mounted for movement, with the seam extending in a direction substantially transverse to a side edge of the photoconductive belt, including:

a first seam detection device positioned to detect a first portion of the seam and generating a first signal indicative thereof;

a second seam detection device, spaced from said first seam detection device, to detect a second portion of the seam and generating a second signal indicative thereof, with there being a time interval between the first signal and the second signal; and a detection circuit, in communication with said first seam detection device and said second seam detection device, for generating a seam identification signal in response to the first signal and the second signal, and the time interval therebetween being within prescribed tolerances.

2. An apparatus according to claim 1, wherein said first seam detection device includes:

a first light source positioned to illuminate at least the first portion of the seam with light rays; and a first light detector, operatively associated with said first light source, to detect the light rays illuminating the first portion of the seam and generating the first signal in response thereto.

3. An apparatus according to claim 2, wherein said second seam detection device includes:

a second light source positioned to illuminate at least the second portion of the seam with light rays; and a second light detector, operatively associated with said second light source, to detect the light rays illuminating the second portion of the seam and generating the second signal in response thereto.

4. An apparatus according to claim 3, wherein the seam extends at an acute angle relative to a line substantially perpendicular to the side edge of the photoconductive belt.

5. An apparatus according to claim 4, wherein the time interval between the first signal and the second signal is a function of the photoconductive belt velocity, the acute angle, and the spacing between said first seam detection device and said second seam detection device.

6. An apparatus according to claim 5 wherein the acute angle ranges from about 2° to about 10° and is preferably about 4°.

7. An apparatus according to claim 5 wherein the time interval ranges from about 50 ms to about 150 ms.

8. An electrophotographic printing machine of the type in which a seam of a photoconductive belt is sensed, the photoconductive belt is mounted for movement with the seam extending in—a—direction substantially transverse to a side edge of the photoconductive belt, including:

a first seam detection device positioned to detect a first portion of the seam and generating a first signal indicative thereof;

a second seam detection device, spaced from said first seam detection device, to detect a second portion of the seam and generating a second signal indicative thereof with there being a time interval between the first signal and the second signal; and a detection circuit, in communication with said first seam detection device and said second seam detection device, for generating a seam identification signal in response to the first signal and the second signal, and the time interval therebetween being within prescribed tolerances.

9. A printing machine according to claim 8, wherein said first seam detection device includes:

a first light source, positioned to illuminate at least the first portion of the seam with light rays; and a first light detector, operatively associated with said first light source, to detect the light rays illuminating the first portion of the seam and generating the first signal in response thereto.

10. A printing machine according to claim 9, wherein said second seam detection device includes:

a second light source positioned to illuminate at least the second portion of the seam with light rays; and a second light detector, operatively associated with said second light source, to detect the light rays illuminating the second portion of the seam and generating the second signal in response thereto.

11. A printing machine according to claim 10, wherein the seam extends at an acute angle relative to a line substantially perpendicular to the side edge of the photoconductive belt.

12. A printing machine according to claim 11, wherein the time interval between the first signal and the second signal is a function of the photoconductive belt velocity, the acute angle, and the spacing between said first seam detection device and said second seam detection device.

13. A printing machine according to claim 12, wherein the acute angle ranges from about 2° to about 10°, and is preferably about 4°.

14. A printing machine according to claim 12, wherein the time interval ranges from about 50 ms to about 150 ms.

* * * * *